United States Patent [19]

Urushibata et al.

[11] Patent Number: 4,945,192

[45] Date of Patent: Jul. 31, 1990

[54] CONNECTOR TERMINAL

[75] Inventors: Kenichi Urushibata; Kiyoto Sugawara; Haruo Saen, all of Tochigi, Japan

[73] Assignee: Sumitomo Electric Industries, Ltd., Osaka, Japan

[21] Appl. No.: 319,184

[22] Filed: Mar. 6, 1989

[30] Foreign Application Priority Data

Mar. 16, 1988 [JP] Japan ..... 63-34964[U]

[51] Int. Cl.[5] ..... H01R 11/01

[52] U.S. Cl. ..... 174/94 R; 174/88 R; 439/59; 439/741; 439/867; 439/882

[58] Field of Search ..... 174/88 R, 94 R, 72 A; 439/59, 81, 83, 629, 741, 865, 867, 876, 877, 882

[56] References Cited

U.S. PATENT DOCUMENTS

| | | | |
|---|---|---|---|
| 3,030,694 | 4/1962 | Kerstetter et al. | 439/865 X |
| 3,051,773 | 8/1962 | Batcheller | 439/877 X |
| 3,425,030 | 1/1969 | Hadden | 439/877 X |
| 3,546,663 | 12/1970 | Holmberg, Jr. | 439/867 X |
| 3,622,955 | 11/1971 | Fernex | 439/867 X |
| 3,729,701 | 4/1973 | Smith | 439/867 X |

FOREIGN PATENT DOCUMENTS

| | | | |
|---|---|---|---|
| 1168935 | 10/1969 | United Kingdom | 439/629 |

*Primary Examiner*—Morris H. Nimmo

*Attorney, Agent, or Firm*—Cushman, Darby & Cushman

[57] ABSTRACT

A connector terminal for joining a round type electric wire with a flat type electric wire. The connector terminal comprises a first crimpable portion for securing the round wire to a first end of the connector terminal, and a clasping portion for securing the flat wire to a second end of the connector terminal, the clasping portion comprising a first and second spring portion, a projecting portion projecting from the clasping portion toward the flat wire, and second crimpable portion for compressing the flat electric wire between the first and second spring portion by securing the first spring portion to the second spring portion. The projecting portion may receive solder so that the first type electric wire can be spot welded to the connector terminal. The resulting connection is extremely compact, reliable, and provides a stable electrical connection over time.

15 Claims, 2 Drawing Sheets

CONNECTOR TERMINAL

BACKGROUND OF THE INVENTION

The present invention relates to a connector terminal for connecting to a flat type electric wire (e.g., connecting a lead wire to a flat conductor), for use in internal wiring such as home equipment, industrial equipment, car equipment, etc.

Conventionally, a round type electric wire has been joined with a flat type electric wire either by directly soldering the wires to a printed circuit board or by connecting the wires to individual connectors respectively, and mounting the connectors onto a printed circuit board.

Such conventional joining techniques, however, have various problems. When a printed circuit board is used, the space for the joint portion cannot be reduced to a small size, making this joining technique unsuitable for small and high-density mounting. Soldering is necessary even when connectors are used. Accordingly, there is difficulty in maintaining sufficient reliability in electric stability and maintaining mechanical strength over a long time, particularly in the case where the joining technique is used for cars. Further, if the connection is made through soldering, when molding work or the like is performed on the joint portion in order to protect the joint portion, there is a possibility that the solder will flow due to the temperature of resin, thus risking a disconnection or short between adjacent circuits.

SUMMARY OF THE INVENTION

An object of the present invention is to solve the problems in the prior art as described above. The present invention provides a connector terminal for joining a round electric wire with a flat conductor, particularly suited for places where the space available is small. It does not require soldering, and yet provides sufficient reliability, electric stability and mechanical strength over a long time.

The connector according to the present invention comprises: a crimpable portion formed at a first end of the connector terminal for fixing a round conductor of a round type electric wire by pressing with, for example, a crimping tool; two spring portions formed at a second end of the connector terminal for sandwiching (e.g., compressing) a rectangular conductor of a flat type electric wire between the two spring portions; a spring-portion crimpable portion formed on one of the two spring portions for crimpable to the other spring portion and the rectangular conductor; and a projecting portion formed on at least one of the two spring portions for making spot-welding with the rectangular conductor. The connector terminal of the present invention sandwiches the flat conductor and compresses it between the two spring portions. The spring portions are located by the spring-portion crimpable portion together with a coated portion of the flat type electric wire so as to fix the rectangular conductor between the spring portions, and the projecting portion is spot-welded on an exposed portion of the rectangular conductor.

DETAILED DESCRIPTION OF THE PREFERRED EMBODIMENT

Figure 1A:
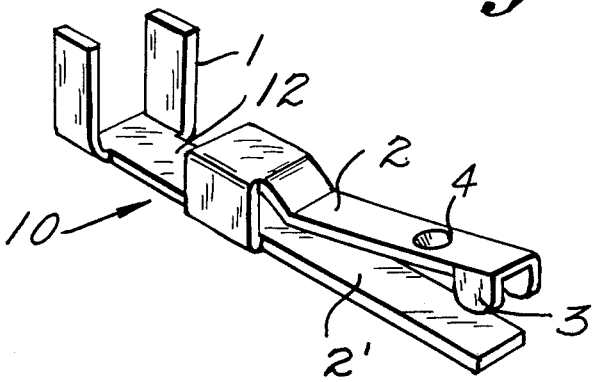
FIG. 1 is a perspective view of an embodiment of the connector terminal according to the present invention.
FIG. 1B is a perspective view of a variation of the embodiment shown in FIG. 1A.

Referring to the drawings, embodiments of the connector terminal according to the present invention will be described.

FIG. 1 is a perspective view showing an embodiment of the connector terminal according to the present invention. Connector terminal 10 comprises round conductor crimpable portion 1 for crimping a round type electric wire. Spring portions 2 and 2' sandwich a flat conductor from its upper and lower sides. Spring-portion crimpable portion 3 is provided for crimpable spring portions 2 and 2' so that spring portions 2 and 2' sandwich the flat conductor. A projecting portion 4 is provided at a substantially central portion of spring portion 2. Alternately, connector terminal 10 may include base portion 12, to which round conductor crimpable portion 1 and spring portion 2 are attached. As shown in FIG. 1A, spring portion 2 is connected to a middle portion of base portion 12. Connector terminal 10 is integrally formed of a single sheet plate as shown in the drawing, for example, tin-plated phosphor bronze plate (having a thickness of 0.25 mm).

Figure 1B:
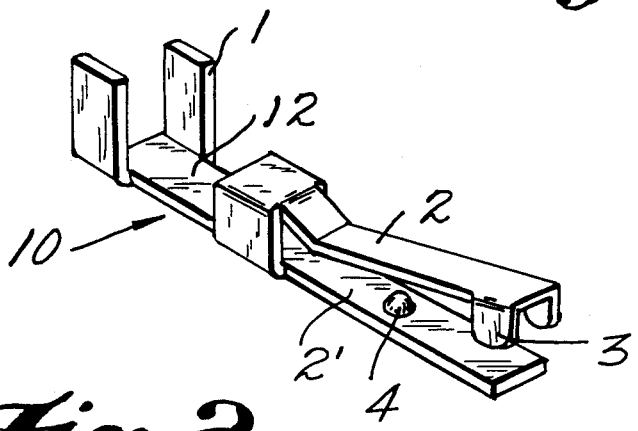
Figure 2:
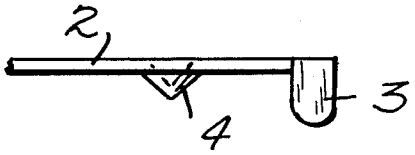
FIG. 2 is a side view of a spring portion for describing a projecting portion.

FIG. 2 is a side view of spring portion 2 for illustrating projecting portion 4. In FIG. 2, the same portions as those in FIG. 1 are correspondingly referenced. Projecting portion 4 is formed in a manner so that the central portion of spring portion 2 extends toward spring portion 2'. The top end of projecting portion 4 is made to abut on the rectangular conductor for the flat type electric wire in order to be spot-welded. Note that the projecting portion 4 alternatively may be formed on the spring portion 2' as shown in FIG. 1B, or on both the spring portions (2 and 2').

Figure 3:
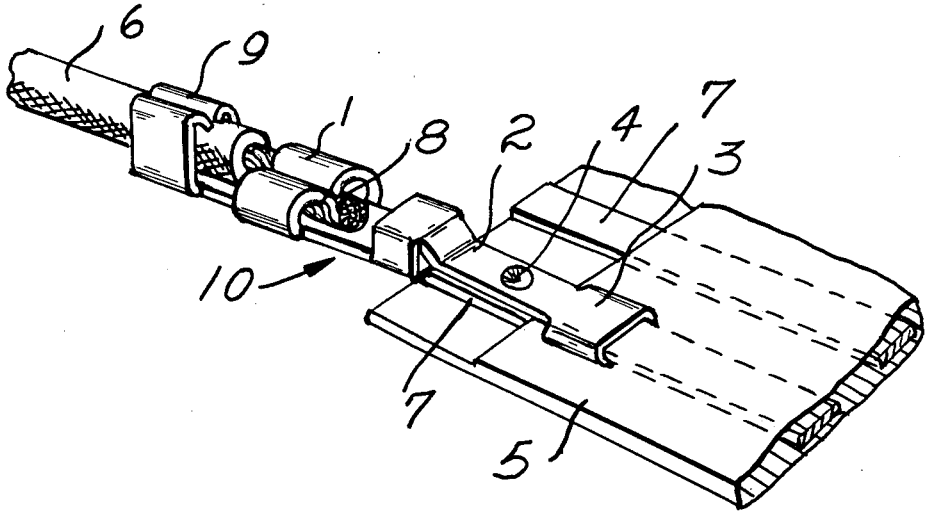
FIG. 3 is a perspective view showing the connection state of the connector terminal according to the present invention.

FIG. 3 is a perspective view showing the connector terminal according to the present invention connecting a round electric wire 6 to flat conductor 7. The same portions as those in FIG. 1A are correspondingly referenced in FIG. 3. Flat conductor 5 has a thickness of 0.35 mm and comprises rectangular conductor 7, made for example of a tin-plated rolled copper foil which is 0.15 mm in thickness and 1.5 mm in width. Round electric wire 6 comprises round conductor 8 having a core electric wire of, for example, 0.5 mm.

When the electric wires are connected to each other, round conductor 8 (e.g., the core electric wire) is made to abut on the round conductor crimpable portion 1. Both ends of round conductor crimpable portion 1 are then crimped together to connect the round type electric wire to the round conductor crimpable portion 1, as shown in FIG. 3.

The connection of flat conductor 5 is made as follows: flat type electric wire 5 is stripped at either one or both of its opposing coated surfaces (one surface in the illustrated case) at the end portion of the flat type electric wire 5, so that rectangular conductor 7 is exposed at that end portion. Each spring portion 2 and 2' of connector terminal 10 has a width corresponding to that of one rectangular conductor 7. Flat type wire 5 is inserted between spring portions 2 and 2' of connector terminal 10 in a manner so that the exposed portion of rectangular conductor 7 is sandwiched between spring portions 2 and 2' and made to abut on projecting portion 4. In that position, force is applied to spring portions 2 and 2' so that they approach each other. The coating of flat type electric wire 5 is thus broken by the spring-portion crimpable portion 3, and the top end of spring-portion crimpable portion 3 is bent so as to crimp spring portion 2 against spring portion 2'. Thus, connector terminal 10 is pressingly attached to the flat type electric wire 5 together with a part of the coating. At this time, spot welding is performed between the top end portion of the projecting portion 4, which is able to receive solder for spot welding, and rectangular conductor 7, so as to securely connect connector terminal 10 and rectangular conductor 7 together.

When only one of the coated surfaces at the end portion of flat type electric wire 5 is stripped, projecting portion 4 need be provided only on one of the spring portions (spring portion 2 in the illustrated case) as shown in FIG. 1. In the case where both the coated surfaces of rectangular conductor are stripped (e.g., upper and lower surface), projecting portion 4 may be provided on each of the spring portions (2 and 2') respectively so that both the projecting portions are spot-welded to the corresponding upper and lower surfaces of rectangular conductor 7.

Although spring-portion crimpable portion 3 is formed on spring portion 2, it may alternatively be formed on the other spring portion 2'.

Figure 4:
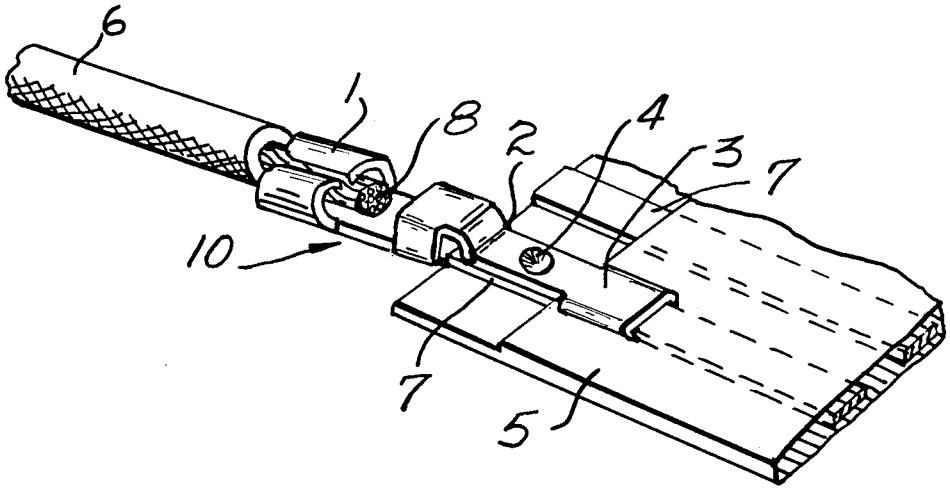
FIG. 4 is a perspective view of another embodiment of the connector terminal according to the present invention.

FIG. 4 is a perspective view showing another embodiment of the connector terminal of the present invention. In the drawing, the same portions as those in FIG. 3 are referenced correspondingly in FIG. 4. Round electric wire crimpable portion 9 is provided further outside round conductor crimpable portion 1 so as to pressingly fix the coated portion of round type electric wire 6. In this embodiment, round conductor 8 of the round electric wire 6 is pressingly fixed to connector terminal 10 not only by round conductor crimpable portion 1 but also by round electric wire crimpable portion 9, so that the holding force against any wire-pulling forces on connector terminal 10 can be greatly improved.

As described above, the connector terminal according to the present invention is formed in a manner so that a round conductor crimpable portion, spring pieces for pressingly fixing a rectangular conductor, and a projecting portion for making spot-welding between the rectangular conductor of the flat type electric wire and the connector terminal are integrally formed with each other. Accordingly, the connection between a round type electric wire and a flat type electric wire can be made extremely compact and highly reliable.

The connector terminal according to the present invention has a further effect that reliable and stable connection can be maintained for a long time when the connector terminal is used for the connection of internal wiring in electronic equipment for home use or for industrial use in which round type electric wires and flat type electric wires coexist, particularly for use in cars.

While this invention has been described in connection with what is presently considered to be the most practical and preferred embodiment, it is to be understood that the invention is not limited to the disclosed embodiment, but, on the contrary, is intended to cover various modifications and equivalent arrangements included within the spirit and scope of the appended claims.

What is claimed is:

1. A connector terminal for connecting a first wire and a second wire comprising:

a base portion having first and second ends;

a first crimpable portion for securing said first wire to said first end of said base portion;

a clasping portion for connecting said second wire to said second end of said base portion, said clasping portion comprising:

a first spring portion having a first end and a second end, said first end of said first spring portion being connected to a middle portion of said base portion, and a second crimpable portion disposed at said second end of said first spring portion for securing said first spring portion to said second end of said base portion, a second wire being disposed between said first spring portion and said second end of said base portion; and a projecting portion projecting from said connector terminal toward said second wire.

2. A connector terminal as recited in claim 1, wherein said first crimpable portion and said clasping portion are integrally formed with said base portion.

3. A connector terminal as recited in claim 2, wherein said connector terminal is integrally formed of a single sheet of metal.

4. A connector terminal as recited in claim 2, wherein said projecting portion receives solder for spot welding said projecting portion to said second wire.

5. A connector terminal as recited in claim 4, wherein said projecting portion is disposed on said first spring portion.

6. A connector terminal as recited in claim 4, wherein said projecting portion is disposed on said second end of said base portion.

7. A connector terminal as recited in claim 2, wherein said second end of said base portion comprises a second spring portion.

8. A connector terminal, having a first and second end, for connecting a first wire and a second wire comprising:

first crimpable portion for connecting said first wire to said first end; and clasping portion for connecting said second wire to said second end, said clasping portion comprising:

a first spring portion having a first end and a second end, a second spring portion having a first end and a second end, said first end of said second spring portion being integrally formed with said first end of said first spring portion, a second wire being disposed between said first and second spring portions, a projecting portion projecting from said clasping portion toward said second wire, and second crimpable portion for securing at said second end of said connector terminal said second end of said first spring portion to said second end of said second spring portion.

9. A connector terminal as recited in claim 8, wherein said first crimpable portion and said clasping portion are integrally formed together.

10. A connector terminal as recited in claim 9, wherein said connector terminal is integrally formed of a single sheet of metal.

11. A connector terminal as recited in claim 8, wherein said projecting portion receives solder for spot welding said projecting portion to said second wire.

12. A connector terminal as recited in claim 11, wherein said projecting portion is disposed on said first spring portion.

13. A connector terminal as recited in claim 11, wherein said projecting portion is disposed on said second spring portion.

14. A connector terminal as recited in claim 8, wherein said second crimpable portion is disposed on said first spring portion.

15. A connector as recited in claim 8, wherein said second crimpable portion is disposed on said second spring portion.

* * * * *